United States Patent [19]

Kiser et al.

[11] Patent Number: 4,502,470

[45] Date of Patent: Mar. 5, 1985

[54] PHYSIOLOGIC DEVICE AND METHOD OF TREATING THE LEG EXTREMITIES

[76] Inventors: John L. Kiser, 3243 E. Murdock #400, Wichita, Kans. 67208; Vernon D. Griffith, 9011 Warren, Wichita, Kans. 67212

[21] Appl. No.: 418,763

[22] Filed: Sep. 16, 1982

[51] Int. Cl.[3] ..... A61H 7/00

[52] U.S. Cl. ..... 128/64; 128/60; 128/87 R; 128/582; 128/DIG. 20

[58] Field of Search ..... 128/24 R, 60, 64, 25 B, 128/582, 402, 165, 166, 89 R, DIG. 20, 87 R; 2/22, 24; 36/71, 93; 272/96

[56] References Cited

U.S. PATENT DOCUMENTS

| | | | |
|---|---|---|---|
| 893,064 | 7/1908 | Ferris | 128/166 |
| 1,288,045 | 12/1918 | Kuhn et al. | 128/383 |
| 2,531,074 | 11/1950 | Miller | 128/64 |
| 2,638,690 | 5/1953 | Bullard | 128/DIG. 20 |
| 2,694,395 | 11/1954 | Brown | 128/64 |
| 2,830,585 | 4/1958 | Weiss | 2/22 |
| 2,884,646 | 5/1959 | Alber | 36/71 |
| 3,469,576 | 9/1969 | Smith et al. | 128/582 |
| 3,548,809 | 12/1970 | Conti | 128/64 |
| 3,888,242 | 6/1975 | Harris et al. | 128/25 B |
| 4,263,905 | 4/1981 | Couch, Jr. | 128/DIG. 20 |
| 4,423,735 | 1/1984 | Comparetto | 128/582 |

FOREIGN PATENT DOCUMENTS

| | | | |
|---|---|---|---|
| 817521 | 7/1959 | United Kingdom | 128/60 |

*Primary Examiner*—Vincent Millin
*Assistant Examiner*—Harry Macey
*Attorney, Agent, or Firm*—John H. Widdowson

[57] ABSTRACT

A physiologic device having a fluid filled compartment. This is surrounded by an outer sheath fastened to the foot. The sheath holds the compartment under the instep and directs the hydraulic forces into the ankle and lower leg. Pressure produced by walking on the fluid compartment is used to compress the lower leg. This prevents swelling and it can heal ulcers due to bad veins.

5 Claims, 8 Drawing Figures

FIG. 2
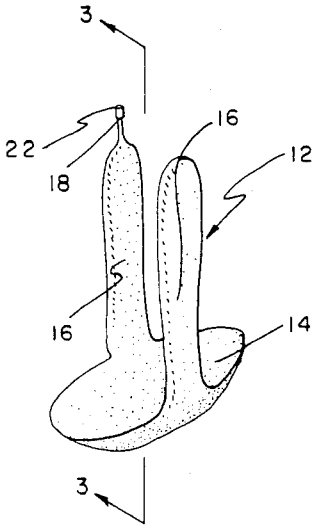
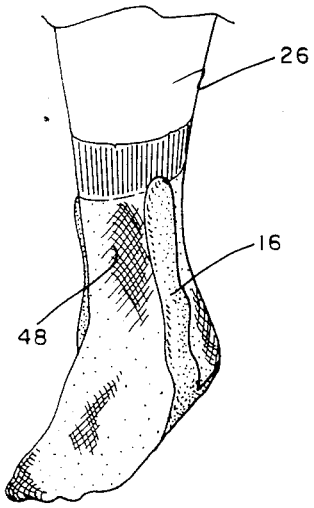
FIG. 1
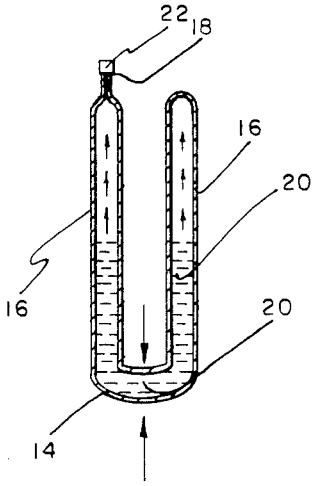
FIG. 3
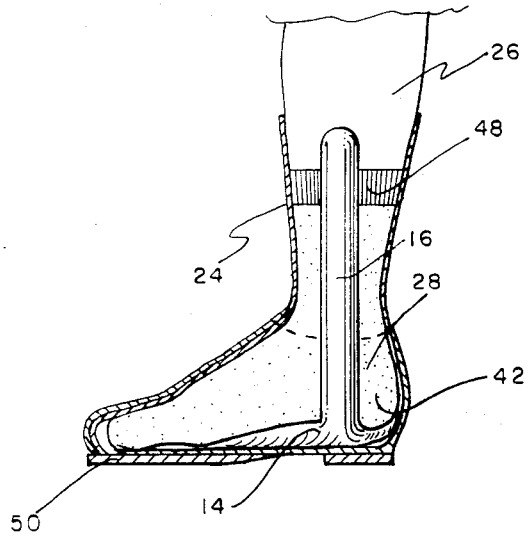
FIG. 4

PHYSIOLOGIC DEVICE AND METHOD OF TREATING THE LEG EXTREMITIES

BACKGROUND OF THE INVENTION

1. Field of the Invention

This invention relates to a physiologic device. More specifically, this invention provides a physiologic deivde and method of treating the leg extremities.

2. Description of Prior Art

U.S. Pat. No. 3,914,881 by Striegel discloses a support pad for insert into a boot or shoe wherein the fluid contained within the insert provides a massage during walking by the user. U.S. Pat. No. 3,407,406 by Werner et al teaches an insert pad for a boot or shoe wherein the same is filled with a fluid-like material that may be shifted during walking by the user. U.S. Pat. No. 3,888,242 by Harris et al illustrates a boot or foot covering that may be provided with fluid under pressure in a pulsating manner to provide a massage for the foot and ankle portion of the body, U.S. Pat. No. 2,531,074 by Miller discloses a pneumatic massage device for the foot and lower leg of the user wheren fluid under pressure is admitted to a plurality of compartments in the foot and leg covering as shown. U.S. Pat. No. 3,548,809 by Conti also discloses a similar type foot and leg covering wherein fluid under pressure in a pulsating manner may be admitted and removed from the covering to provide the massage. None of the foregoing prior art patents disclose the particular physiological device and method of this invention.

SUMMARY OF THE INVENTION

This invention accomplishes its desired objects by providing a novel physiologic device comprising a U-shaped reservoir or compartment means; fluid means contained with the compartment means; and an outer sheath means fastened to the foot to maintain the reservoir means including the fluid means contained therein around the instep, ankle and lower leg of the wearer or user such that the fluid forces are directed into the ankle and the lower leg as high as the knee. The process for treating a leg includes surrounding a portion of the foot of the leg to be treated with a reservoir means containing a fluid means; pressurizing the reservoir means below the instep portion of the foot by the user stepping down on the same; and flowing the fluid means from the instep portion into the ankle and calf area of the user's leg in order to increase the pressure in the areas of the same to give therapeutic value in treating the user suffering from incompetent veins in the leg.

It is an object of the invention to provide a novel physiologic device which is capable of easily being manufactured.

Still further objects of the invention reside in the provision of a method of treating a leg and a physiologic device which is relatively inexpensive to manufacture.

These together with the various ancillary objects and features will become apparent as the following description proceeds, are attained by this invention, preferred embodiments being shown in the accompanying drawings, by way of example only, wherein:

BRIEF DESCRIPTION OF THE DRAWINGS

FIG. 1 is a perspective view of the U-shaped fluid reservoir or compartment passing under the instep, around the ankle and up to the top of a sock fitted to a person's foot;

FIG. 2 is a perspective view of the U-shaped fluid reservoir or compartment;

FIG. 3 is a vertical sectional view taken in direction of the arrows and along the plane of line 3—3 in FIG. 2;

FIG. 4 is a vertical sectional view of the U-shaped reservoir or compartment fitted to a person's foot;

DETAILED DESCRIPTION OF THE INVENTION

Figure 8:
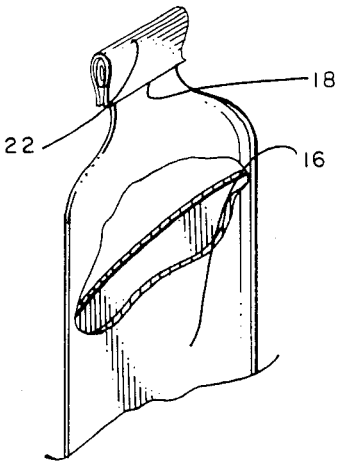
FIG. 8 is a partial perspective view of the U-shaped reservoir or compartment disclosing the sealed opening wherein fluid is introduced into the reservoir or compartment.

Referring in detail now to the drawings, wherein like reference numerals represent similar parts of the invention throughout the various views, there is seen a physiologic device, generally illustrated as 10, comprising a generally U-shaped reservoir or compartment, gererally illustrated as 12, (see FIG. 2) having a base 14 and a pair of extending upright arms 16—16. An arm 16 has an opening 18 in the top thereof wherethrough a fluid means 20 (eg. water, air, water-glyceral, etc.) is poured or placed in order to partially fill the reservoir 12. A clamp means 22 (see FIG. 8) secures opening 18.

Figure 5:
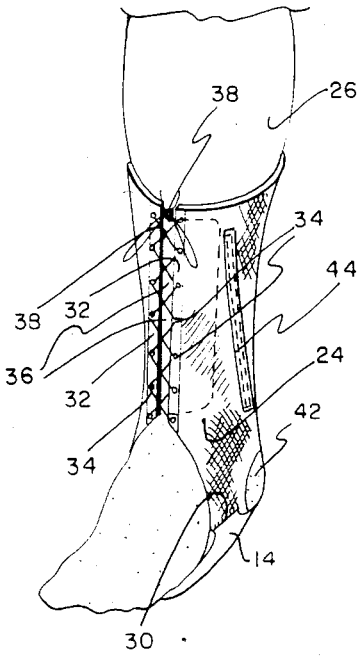
FIG. 5 is a perspective view of the sheath holding the U-shaped reservoir of compartment in place such that the fluid forces are directed into the lower part of the leg itself.
Figure 6:
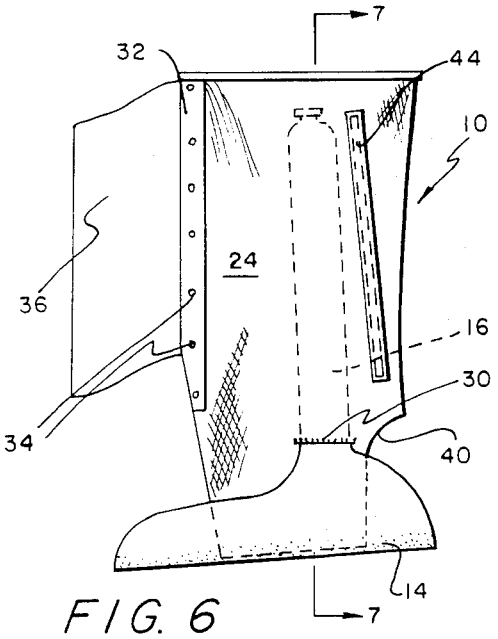
FIG. 6 is a side elevational view of the sheath and U-shaped fluid reservoir or compartment.

A sheath 24 is fastened to the lower extremity of a leg 26 of a user to maintain the pair of extending reservoir arms 16—16 against an ankle 28 and lower extremity of the leg 26 such that when the user or wearer steps down on top of the reservoir base 14, the fluid means 20 is directed up into the pair of reservoir arms 16—16 as indicated in FIG. 3. The sheath 24 has a pair of slits 30—30 in proximity to the portion of the sheath that wraps against the ankle 28 of the user (see FIGS. 5 and 6); and a pair of edges 32—32. Each edge 32 is aligned with a vertical series of lacing apertures 34. The lacing apertures 34 of one edge 32 generally register with the lacing apertures 34 of the other edge 32 when the pair of edges 32—32 is folded towards the shin of the user (see FIG. 5). A tongue 36 is stitched in proximity to one of the pair of edges 32—32 as to rest against the shin of the user and to provide a cushion for a lace 38 that laces back and forth through the registered lacing apertures 34.

Figure 7:
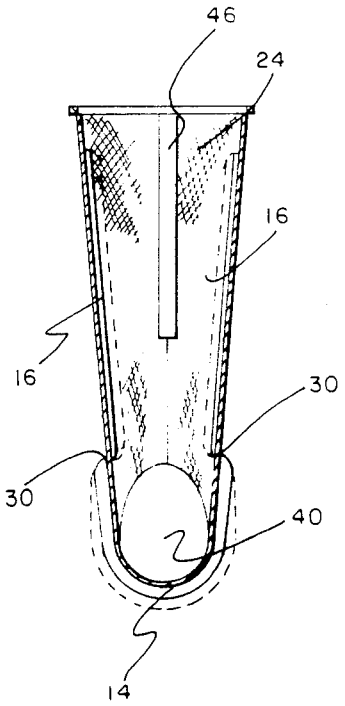
FIG. 7 is a vertical sectional view taken in direction of the arrows and along the plane of line 7—7 is FIG. 6.

The pair of reservoir arms 16—16 extends through the slits 30—30 (see FIGS. 6 and 7) and are stitched to the inside of the sheath 24 to rest in contact with the ankle 28 and lower extremities of the leg 26 of the user, and the bottom of the sheath 24 is flushed against the top of the reservoir base 14 when worn by the user. The sheath 24 is provided with a heel aperture 40 (see FIG. 7) wherethrough a heel 42 of the user lodges and extends when the device 10 is worn. A pair of ribs 44—44 and spine 46 provide structural support for the device 10.

In a preferred embodiment of the invention, the user should preferably wear a sock 48 between the skin and the U-shaped reservoir. A shoe 50 may be worn over the device 24 when secured to the leg 26 of the wearer.

With continuing reference to the drawings for operation of the invention and a process for treating the lower extremities of the leg 26, the ball, arch and heel (i.e. the undersurface in general) of a foot and the ankle 28 and part of the lower extremities of the leg 26 are surrounded with the U-shaped reservoir 12 as indicated in FIGS. 1 and 4. The reservoir 12 is only partially filled with fluid 20 as illustrated in FIG. 3; this is an important feature of the invention. When the user of the device 10 walks and the instep portion of the user's foot steps down on the top of the reservoir base 14; this pressurizes the reservoir base 14 and causes a portion of the fluid means 20 to flow into the pair of reservoir arms 16—16 (see FIG. 3) which is contiguous to the ankle 28 and a portion of the lower extremities of the leg 26. The flowing fluid means 20 in the reservoir arms 16—16 gives massage-like action forces and therapeutic value in treating the lower extremities of the leg 26 for healing sores, incompetent veins, and the like.

Thus, the device 10 of this invention uses hydraulic forces generated with patient's weight as he or she steps to produce a normal flow of blood through the skin and lower leg 26. In patients with venous insufficiency this device 10 is designed to effect a normal blood flow. It is also an effective method of reducing swelling which is a detriment to healing and a major cause of discomfort. This invention specially aids the patient in dealing with complex problems of stasis dermatitis and deep vein thrombosis.

The device 10 of this invention further reproduces the natural hydraulic forces which propel the blood back to the heart. The magnitude of these hydraulic forces can be appreciated when one considers the fact that the pressure exerted by a column of water from the floor to the heart in a standing person is equivalent to the diastolic blood pressure. As the patient steps upon the top of the reservoir base 14, a hydraulic pressure wave is created which is transmitted into the reservoir arms 16—16 to effectively massage the lower extremities of the patient's leg 26 contiguous to the reservoir arms 16—16, and when the patient raises his foot as in walking, the pressure is released during each step. Patients who have used this device 10 have found it comfortable and compatible with their normal acitvities. One of the advantages of this device 10 is the continued ambulation of the patient. The device reproduces the natural muscular pumping actions which occur in the normal leg. Thus it deserves to be called a physiologic device.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A physiologic device comprising a generally U-shaped reservoir means having a base and a pair of extending essentially upright arms in fluid communication with the base of the reservoir means;

a fluid means partially filling said reservoir means; and a sheath means adapted to be wrapped around the lower extremity of a person's leg comprising upwardly extending side portions adapted to substantially encircle the ankle and lower leg, the side portions comprising a pair of edges having fastening means for releasably fastening the same to one another thereby securing the sheath means to the lower extremity of a person's leg; said sheath means further comprising a lower base portion, between the side portions, adapted to substantially encircle the foot, having opposed aperture means for receiving the reservoir arms and holding the same in the proximity of the side portions of the sheath means; wherein the reservoir means is releasably connected to the sheath means by the aperture means such that the base of the reservoir means is positioned outside of the sheath means and the arms of the reservoir means are positioned within the sheath means; thereby providing pressure pulsations, developed at the base of the reservoir means and produced by walking, to be transmitted to the arms of the reservoir means and lower extremity of the leg where a pathological condition may exist.

2. The device of claim 1 wherein at least one of the pair of reservoir arms has an opening in the top thereof for the placement of the fluid means into the reservoir means.

3. The device of claim 2 additionally comprising a tongue means stitched in proximity to one of the pair of edges and adapted to rest against the shin of the user when the edges of the sheath means are folded towards the shin of the user.

4. The device of claim 3 wherein the structure of the sheath means additionally defines an aperture, between the side portions and base portion, adapted to receive therethrough and lodge extended the heel of the user when the device is worn.

5. The device of claim 3 wherein said sheath means additionally comprises a plurality of reinforcement members therein.

* * * * *